US010360769B2

(12) United States Patent
Palermo et al.

(10) Patent No.: US 10,360,769 B2
(45) Date of Patent: Jul. 23, 2019

(54) GAMING MACHINE, SYSTEM, AND METHOD FOR INTRODUCING SKILL-DEPENDENT PLAY IN A WAGERING GAME

(71) Applicant: Everi Games, Inc., Austin, TX (US)

(72) Inventors: James V. Palermo, Austin, TX (US); Juan Mariscal, Chicago, IL (US); Darren Yat-man Ng, Chicago, IL (US)

(73) Assignee: Everi Games, Inc., Austin, TX (US)

( * ) Notice: Subject to any disclaimer, the term of this patent is extended or adjusted under 35 U.S.C. 154(b) by 119 days.

(21) Appl. No.: 15/271,321

(22) Filed: Sep. 21, 2016

(65) Prior Publication Data

US 2018/0082541 A1 Mar. 22, 2018

(51) Int. Cl.
*G07F 17/32* (2006.01)

(52) U.S. Cl.
CPC ..... *G07F 17/3295* (2013.01); *G07F 17/3209* (2013.01); *G07F 17/3211* (2013.01); *G07F 17/3225* (2013.01); *G07F 17/3262* (2013.01)

(58) Field of Classification Search
CPC ..... G07F 17/3262; G07F 17/3295; G07F 17/3209; G07F 17/3211; G07F 17/3225
See application file for complete search history.

(56) References Cited

U.S. PATENT DOCUMENTS 6,780,103 B2 * 8/2004 Bansemer ..... A63F 9/0291 463/25
6,942,568 B2 * 9/2005 Baerlocher ..... G07F 17/32 463/16
8,087,999 B2 * 1/2012 Oberberger ..... G07F 17/32 463/25
8,308,556 B2 * 11/2012 Thomas ..... G07F 17/32 345/474
2008/0108425 A1 * 5/2008 Oberberger ..... G07F 17/32 463/25
2008/0113697 A1 * 5/2008 Rommerdahl ..... G07F 17/32 463/7
2008/0261680 A1 * 10/2008 Buecheler ..... G07F 17/3239 463/23
2009/0061999 A1 * 3/2009 Popovich ..... G07F 17/32 463/26
2009/0131158 A1 * 5/2009 Brunet De Courssou ..... G07F 17/32 463/26

(Continued)

*Primary Examiner* — Xuan M Thai
*Assistant Examiner* — Malina D. Blaise
(74) *Attorney, Agent, or Firm* — The Culbertson Group, P.C.; Russell D. Culbertson

(57) ABSTRACT

A method includes receiving a skill level input specifying a first skill level from a set of different skill levels, and in response to the skill level input, placing the gaming machine in a first state. Each respective skill level in the set of different skill levels is correlated to a different respective proportion between a player skill-dependent component and random component of the wagering game. Thus placing the gaming machine in the first state has the effect of setting that skill-dependent to random proportion to a desired value. After placing the gaming machine in the first state, the method includes receiving player inputs for which a prize may ultimately be awarded. This prize is determined by (i) any player inputs included in the player input set for the player skill-dependent component and (ii) the random component in an award proportion based on the desired value.

17 Claims, 9 Drawing Sheets

(56) References Cited

U.S. PATENT DOCUMENTS

| | | | | |
|---|---|---|---|---|
| 2009/0280891 | A1* | 11/2009 | Filipour | G07F 17/32 463/22 |
| 2009/0312081 | A1* | 12/2009 | Head | G07F 17/32 463/8 |
| 2010/0120502 | A1* | 5/2010 | Oberberger | G07F 17/3244 463/20 |
| 2011/0009178 | A1* | 1/2011 | Gerson | G07F 17/3295 463/17 |
| 2011/0053676 | A1* | 3/2011 | Wolf | G07F 17/3258 463/20 |
| 2011/0118011 | A1* | 5/2011 | Filipour | G07F 17/32 463/27 |
| 2011/0218035 | A1* | 9/2011 | Thomas | G07F 17/32 463/25 |
| 2012/0077569 | A1* | 3/2012 | Watkins | G07F 17/3267 463/25 |
| 2012/0115581 | A1* | 5/2012 | Englman | G07F 17/34 463/25 |
| 2013/0281171 | A1* | 10/2013 | Ramsour | G07F 17/326 463/10 |
| 2014/0087808 | A1* | 3/2014 | Basallo | G07F 17/3262 463/16 |
| 2014/0228086 | A1* | 8/2014 | Smith | G07F 17/326 463/7 |
| 2014/0323204 | A1* | 10/2014 | Paradise | A63F 13/35 463/23 |
| 2015/0287264 | A1* | 10/2015 | De Viveiros Ortiz | G07F 17/3244 463/25 |
| 2016/0012675 | A1* | 1/2016 | Arnone | G07F 17/32 463/10 |
| 2016/0035190 | A1* | 2/2016 | Arnone | G07F 17/3258 463/27 |

* cited by examiner

GAMING MACHINE, SYSTEM, AND METHOD FOR INTRODUCING SKILL-DEPENDENT PLAY IN A WAGERING GAME

TECHNICAL FIELD OF THE INVENTION

The present invention relates to gaming machines and gaming machine systems in which results for wagers may be based at least in part on the skill of a player where the results are otherwise randomly determined.

BACKGROUND OF THE INVENTION

Wagering games conducted through electronic gaming machines commonly produce game outcomes that are randomly determined according to a suitable algorithm or process. The algorithm or process is designed to ensure, on average, a certain return to the player ("return-to-player") in terms of some fraction of the wagers made in the game over time. For example, the return-to-player for a wagering game such as a video or mechanical reel-type game conducted through an electronic gaming machine may range from 94% to 99%. Thus prizes awarded to players in the wagering game over time represent a relatively large portion relative to the wagers made for the game over time, with the remainder representing a hold portion to compensate the gaming machine operator.

Although wagering games conducted through electronic gaming machines commonly produce outcomes for play purely randomly, players may find games that require some degree of skill more desirable than purely random outcome games. This player preference may be based on the player's desire to have some control over the outcomes for their wagers. Also, games that test player skill may generate more player excitement than games in which the outcomes are purely random. In view of the perceived popularity of skill-based games, it may be desirable for casino operators to offer gaming machine-implemented games which require some degree of player skill. However, although return-to-player may be controlled with mathematical precision where game outcomes are purely randomly determined, it is inherently more difficult to control return-to-player in games which require some degree of skill on the part of the player. This is so because the various types of player skill that may be required for skill-based games may vary wildly from one player to the next.

Because return-to-player is more difficult to control in skill-based games, such games raise regulatory issues and also practical issues for game operators. Despite the perceived popularity of skill-based games, the difficulty in controlling the return-to-player for skill-based games may make casino operators hesitant to offer such games.

SUMMARY OF THE INVENTION

Embodiments of the present invention provide a mechanism for introducing skill-based gaming in wagering games offered through electronic gaming machines. In particular, implementations of the present invention allow a skill-based component of a wagering game offered through an electronic gaming machine to be configured as desired to limit issues with return-to-player. This configurability allows game operators to offer skill-based games while minimizing the problems associated with such games.

One aspect of the present invention includes a method for introducing player skill-dependent play through a gaming machine for a wagering game. A method according to this aspect of the invention includes receiving a skill level input specifying a first skill level from a set of different skill levels, and in response to the skill level input, placing the gaming machine in a first state. Each respective skill level in the set of different skill levels is correlated to a different respective proportion between a player skill-dependent component of a portion of the wagering game and a random component of the portion of the wagering game. Thus placing the gaming machine in the first state has the effect of setting the proportion between the player skill-dependent component and the random component to a first value. After placing the gaming machine in the first state, the method includes receiving a player input set through a player input system of the gaming machine. This player input set includes at least one player input for the portion of the wagering game to which the skill-dependent to random proportion applies. In response to the player input set the processing system associated with the gaming machine awards a prize at the gaming machine for the portion of the wagering game. This prize is determined by (i) any player inputs included in the player input set for the player skill-dependent component and (ii) the random component in an award proportion based on the first value, that is, the value of the proportion of skill-dependent component to random component that was set by the skill level input. That the award proportion is "based on" the first value in this sense means that over the course of time, the award proportion from a probabilistic standpoint will equal or approximate to the first value, the proportion set for the game according to the skill level input.

A method according to this first aspect of the invention allows a user, such as authorized personnel of the gaming machine operator, or perhaps even a player at the gaming machine, to configure the gaming machine to allow a desired degree of skill-dependent play. The skill-dependent component might be determinative of the entire result for a given wager or only a portion of the result, with the rest of the result being determined randomly. This configurability at least by the gaming machine operator allows the operator to introduce a desired level of skill into wagering games to attract players who might otherwise be uninterested in games offered through the gaming machine. The configurability also allows the proportion of skill-dependent component to random component may be set to reduce some of the issues and risk to the operator arising from the skill-dependent component.

Embodiments according to this first aspect of the invention may include any of a number of different arrangements for facilitating the desired skill-dependent component configurability. In some embodiments, the portion of the wagering game includes (that is, requires) multiple discrete activations of either a first game or a second game (or perhaps more games). Each of the different games has a different proportion between a player skill-dependent component and a random component, with some games having a relatively high skill-dependent component (even 100%) and others having a low or no skill-dependent component. In these embodiments the processing system associated with the gaming machine selects the different games for the multiple discrete activations so that an overall proportion between the player skill-dependent component and random component for the multiple discrete activations is equal to the desired skill-dependent to random component proportion, particularly the proportion set by the user input.

In other embodiments the configurability may be effected using a single type of game to introduce a skill-dependent component. In these embodiments the player input set includes a number of skill-dependent inputs and the prize awarded at the gaming machine includes a unified value displayed through a display system of the gaming machine after completion of the number of skill-dependent inputs. The unified value includes a portion determined at random according to the selected value for the proportion between the player skill-dependent component and the random component for the portion of the wagering game. The remainder of the unified value is determined by the successful skill-dependent inputs entered by the player during the course of the game. That is, the prize awarded at the gaming machine and represented by the unified value is made up of (i) a respective first credit award for each successful skill-dependent input in the player input set, and (ii) for each unsuccessful skill-dependent input in the player input set, a respective credit award issued according to a probability equal to unity less the value representing the skill-dependent to random component proportion.

Methods according to this first aspect of the invention may include any of a number of different arrangements for receiving the user input (skill level input) to set the desired skill-dependent to random component proportion. In some embodiments the user interface includes a continuum over a range of skill level values, and receiving the skill level input includes receiving an indication of a placement of a position indicator along the continuum. In other embodiments the user interface includes a control displaying a number of (two or more) alternatively selectable discrete skill levels and wherein receiving the skill level input includes receiving an input corresponding to a selected one of the discrete skill levels.

Some embodiments may alternatively or in addition to the manual (user input-based) selection of skill-dependent component to random component proportion, include a process for dynamically selecting the proportion to be applied. Such a dynamic process may include monitoring an indicator of actual return-to-player for one or more instances of the portion of the wagering game. In response to the indicator of actual return-to-player for the one or more instances of the portion of the wagering game reaching a predefined intervention value, the process places the gaming machine in a second state having a lower proportion of player skill-dependent component to random component. Thus, for example, in the event a player enters too many unsuccessful inputs at a relatively high skill-dependent component so that the unsuccessful inputs reduce the return-to-player undesirably, the invention may dynamically reduce or eliminate the skill-dependent component to help bring the return-to-player back to an acceptable level.

The invention also encompasses gaming machines and gaming machine systems controlled to implement the above method. Also, because a gaming machine may be implemented using one or more general purpose processing devices to direct the various functions described above and in more detail below, the invention also encompasses a program product comprising non-transitory storage media storing program code which is executable to direct the various gaming machine functions. Methods, gaming machines, gaming machine networks, and program products embodying principles of the invention will be described in detail below in connection with the drawings.

These and other advantages and features of the invention will be apparent from the following description of representative embodiments, considered along with the accompanying drawings.

DESCRIPTION OF REPRESENTATIVE EMBODIMENTS

In the following description, FIGS. 1-3 will be used to describe example gaming machines and gaming networks through which the present invention may be implemented. FIGS. 4-13 will be used to describe processes and features which are illustrative of various embodiments of the invention.

Figure 1:
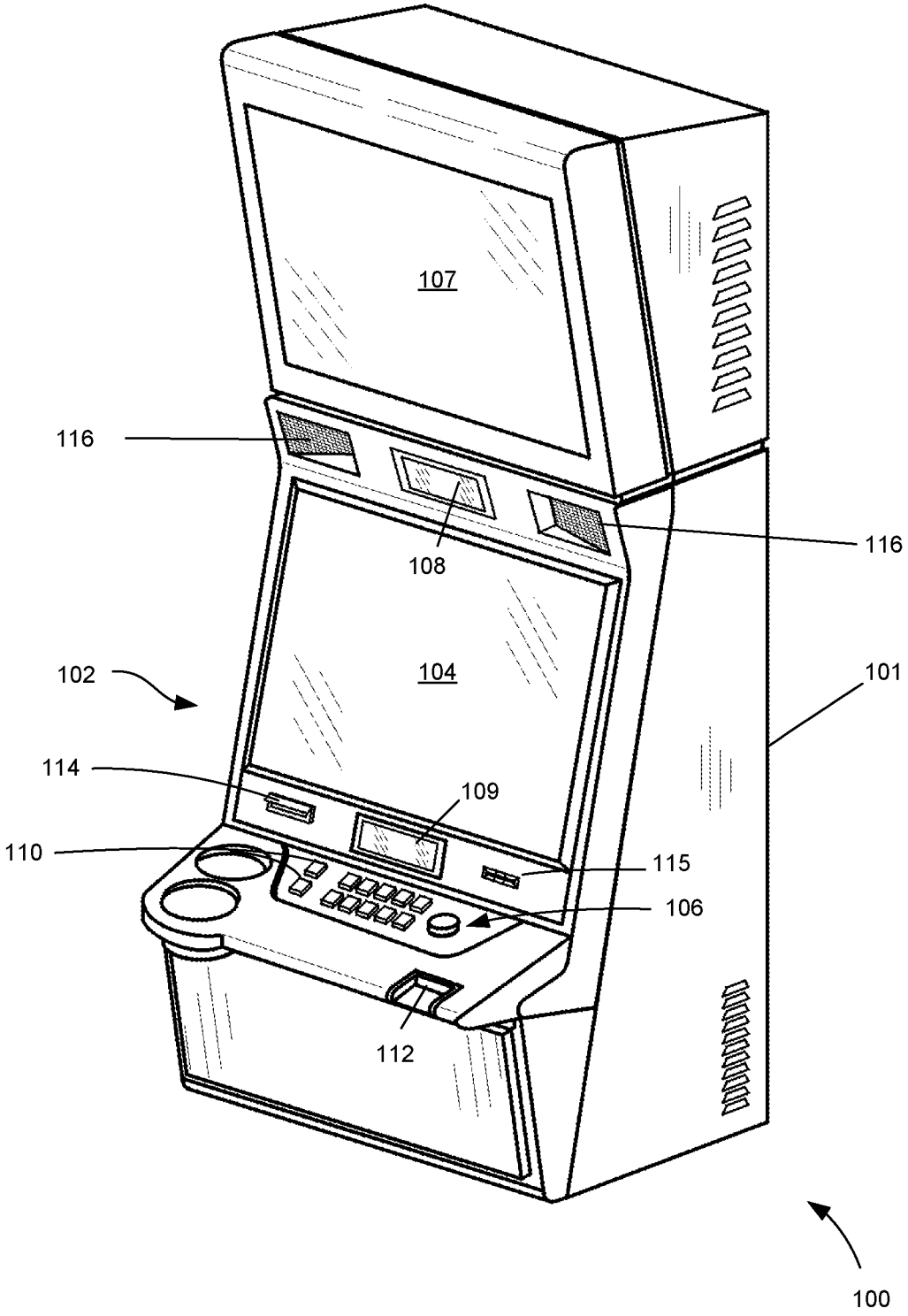
FIG. 1 is a view in perspective of a gaming machine which may be employed to implement various embodiments of the present invention.

FIG. 1 shows a gaming machine 100 that may be used in implementing a wagering game which may be configured according to the present invention. The block diagram of FIG. 2 shows further details of gaming machine 100 along with certain variations which may be included in the gaming machine. FIG. 3 shows an example gaming network in which gaming machines such as gaming machine 100 may be employed.

Referring to FIG. 1, gaming machine 100 includes a cabinet 101 having a front side generally shown at reference numeral 102. A primary video display device 104 is mounted in a central portion of the front side 102, and a button panel 106 is positioned below the primary video display device so as to project forwardly from the plane of the primary video display device. In addition to primary video display device 104, the illustrated gaming machine 100 includes a secondary video display device 107 positioned above the primary video display device. Gaming machine 100 also includes two additional smaller auxiliary display devices, an upper auxiliary display device 108 and a lower auxiliary display device 109. It should also be noted that each display device referenced herein may include any suitable display device including a cathode ray tube, liquid crystal display, plasma display, LED display, or any other type of display device currently known or that may be developed in the future. One or more of these video display devices, and especially primary video display device 104, may be used to display graphics used to display symbol location sets and other elements according to the present invention. As will be described further below in connection with FIG. 2 and elsewhere, it is also possible for gaming machines within the scope of the present invention to include mechanical elements such as mechanical reels. In these mechanical reel implementations, the mechanical reels may be used to display the game symbol locations. Generally, the display device or display devices of the gaming machine, whether video display devices, mechanical devices, or combinations of the two, which are used to display graphic elements according to embodiments of the invention may be described in this disclosure and the accompanying claims as a "display system."

The gaming machine 100 illustrated for purposes of example in FIG. 1 also includes a number of mechanical control buttons 110 mounted on button panel 106. These control buttons 110 may allow a player to select a bet level, select a type of game or game feature, and make a play input to start a play in a game. Other forms of gaming machines through which the invention may be implemented may include switches, joysticks, or other mechanical input devices, and/or virtual buttons and other controls implemented on a suitable touch screen video display. For example, primary video display device 104 in gaming machine 100 provides a convenient display device for implementing touch screen controls in addition to or in lieu of mechanical controls included on button panel 106. Also, as will be described further below, button panel 106 in the illustrated location preferably comprises a touch screen display that may be controlled to produce any desired touch screen button configuration, particularly to accommodate different numbers of bet levels for a given game and denomination. The player interface devices which receive player inputs in the course of a game played through the gaming machine, such as controls to select a wager amount for a given play, controls to enter a play input to actually start a given play in the wagering game or tournament game, or controls to allow a player to make other player selections in a game according to the present invention, may be referred to generally as a "player input system."

It will be appreciated that gaming machines may also include a number of other player interface devices in addition to devices that are considered player controls for use in entering inputs in the course of a particular game. Gaming machine 100 also includes a currency/voucher acceptor having an input ramp 112 operable to accept a physical item (such as cash, a voucher, mag stripe card, chip-enabled card, etc.) associated with monetary value, a player card reader having a player card input 114, and a voucher/receipt printer having a voucher/receipt output 115. Numerous other types of player interface devices may be included in gaming machines that may be used to implement embodiments of the present invention.

A gaming machine which may be used to implement embodiments of the present invention may also include a sound system to provide an audio output to enhance the user's playing experience. For example, illustrated gaming machine 100 includes speakers 116 which may be driven by a suitable audio amplifier (not shown) to provide a desired audio output at the gaming machine.

Figure 2:
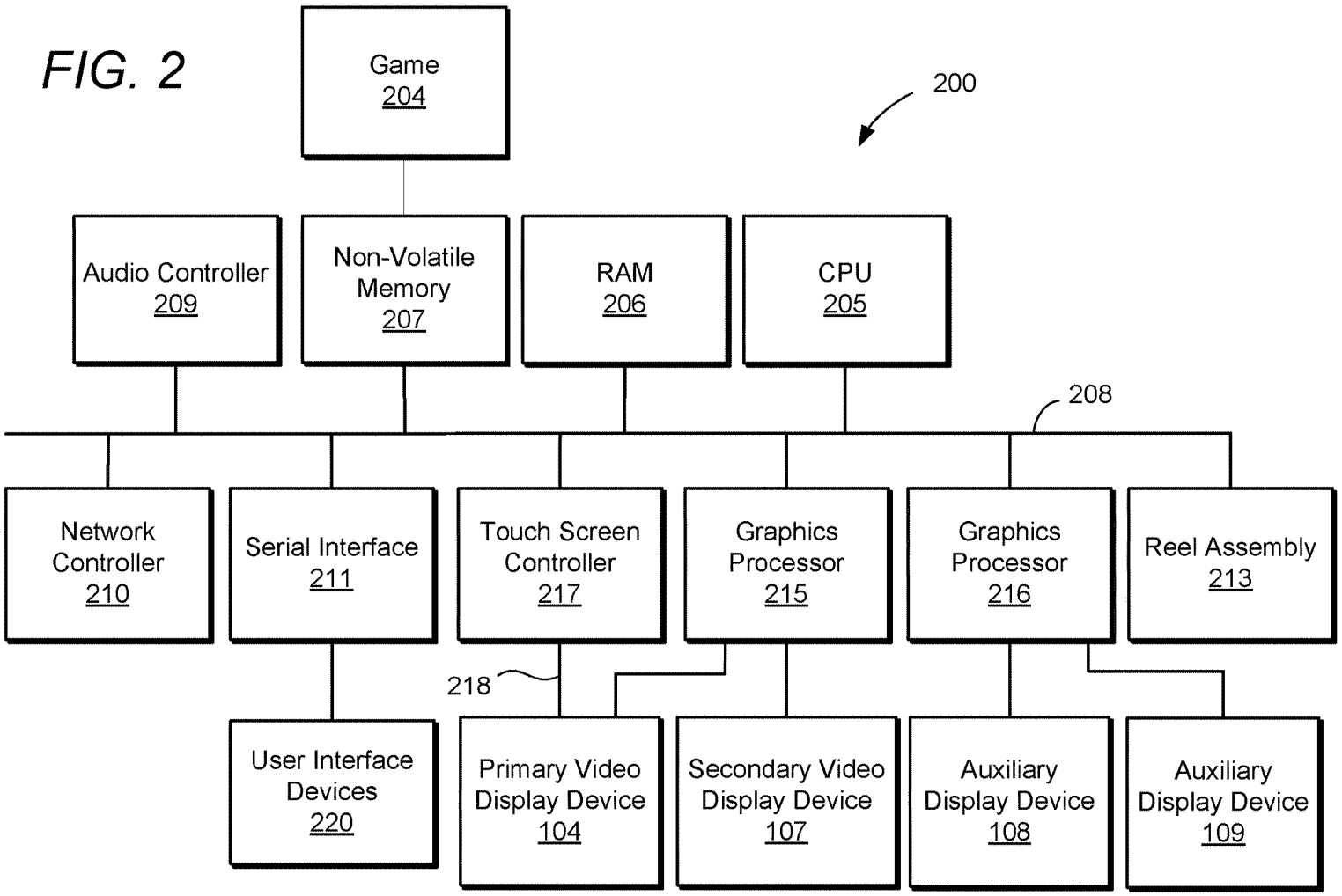
FIG. 2 is a diagrammatic representation of the gaming machine shown in FIG. 1 showing various components of the gaming machine.

FIG. 2 shows a logical and hardware block diagram 200 of gaming machine 100 which includes a processor (CPU) 205 along with random access memory (RAM) 206 and nonvolatile memory or storage device 207. All of these devices are connected on a system bus 208 with an audio controller device 209, a network controller 210, and a serial interface 211. A graphics processor 215 is also connected on bus 208 and is connected to drive primary video display device 104 and secondary video display device 107 (both mounted on cabinet 101 as shown in FIG. 1). A second graphics processor 216 is also connected on bus 208 in this example to drive the auxiliary display devices 108 and 109 also shown in FIG. 1. As shown in FIG. 2, gaming machine 100 also includes a touch screen controller 217 connected to system bus 208. Touch screen controller 217 is also connected via signal path 218 to receive signals from a touch screen element associated with primary video display device 104. It will be appreciated that the touch screen element itself typically comprises a thin film that is secured over the display surface of the respective display device, in this case primary video display device 104. The touch screen element itself is not illustrated or referenced separately in the figures.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 2 are elements commonly associated with a personal computer. These elements may be mounted on (or connected to) a standard personal computer motherboard and housed in a standard personal computer housing which itself may be mounted in cabinet 101 shown in FIG. 1. Alternatively, the various electronic components may be mounted on one or more circuit boards housed within cabinet 101 without a separate enclosure such as those found in personal computers. Those familiar with data processing systems and the various data processing elements shown in FIG. 2 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 2 as being connected directly on system bus 208 may in fact communicate with the other system components through a suitable expansion bus. Audio controller 209, for example, may be connected to the system via a PCI or PCIe bus. System bus 208 is shown in FIG. 2 merely to indicate that the various components are connected in some fashion for communication with CPU 205 and is not intended to limit the invention to any particular bus architecture. Numerous other variations in the gaming machine internal structure and system may be used without departing from the principles of the present invention. For example, a gaming machine in some embodiments of the present invention may rely on one or more data processors which are located remotely from the gaming machine itself. Embodiments of the present invention may include no processor such as CPU 205 or graphics processors such as 215 and 216 at the gaming machine, and may instead rely on one or more remote processors. Thus unless specifically stated otherwise, the designation "gaming machine" is used in this disclosure and the accompanying claims to designate a system of devices which operate together to provide the indicated functions. A "gaming machine" may include a gaming machine such as gaming machine 100 shown in FIGS. 1 and 2, which is itself a system of various components, and may also include one or more components remote from a gaming machine cabinet (that is, cabinet 101 in FIG. 1). Thus the designation "gaming machine" encompasses both a stand-alone gaming machine and a gaming machine (that is, the part housed in a cabinet such as cabinet 101 in FIG. 1) along with one or more remote components for providing various functions (such as generating outcomes for plays in a game, and driving display devices mounted in the gaming machine cabinet).

It will also be appreciated that graphics processors are also commonly a part of modern computer systems. Although separate graphics processor 215 is shown for controlling primary video display device 104 and secondary video display device 107, and graphics processor 216 is shown for controlling both auxiliary display devices 108 and 109, CPU 205 or a graphics processor packaged with or included with CPU 205 may control all of the display devices directly without any separately packaged graphics processor. The invention is not limited to any particular arrangement of processing devices for controlling the video display devices included with gaming machine 100. Also, a gaming machine implementing the present invention is not limited to any particular number of video display devices or other types of display devices.

In the illustrated gaming machine 100, CPU 205 executes software, that is, program code, which ultimately controls the entire gaming machine including the receipt of player inputs and the presentation of the graphics or information displayed according to the invention through the display devices 104, 107, 108, and 109 associated with the gaming machine. CPU 205 also executes software related to communications handled through network controller 210, and software related to various peripheral devices such as those connected to the system through audio controller 209, serial interface 211, and touch screen controller 217. CPU 205 may also execute software to perform accounting functions associated with game play. Random access memory 206 provides memory for use by CPU 205 in executing its various software programs while the nonvolatile memory or storage device 207 may comprise a hard drive or other mass storage device providing storage for game software such as program code 204 (which may include program code to implement the skill level configurability facilitated according to the present invention) prior to loading into random access memory 206 for execution, or for programs not in use or for other data generated or used in the course of gaming machine operation. Network controller 210 provides an interface to other components of a gaming system in which gaming machine 100 may be included. An example network will be described below in connection with FIG. 3.

It should be noted that the invention is not limited to gaming machines employing the personal computer-type arrangement of processing devices and interfaces shown in example gaming machine 100. Other gaming machines through which the invention may be implemented may include one or more special purpose processing devices to perform the various processing steps for implementing the invention. Unlike general purpose processing devices such as CPU 205, which may comprise an Intel Pentium® or Core® processor for example, these special purpose processing devices may not employ operational program code to direct the various processing steps.

The example gaming machine 100 is shown in FIG. 2 as including user interface devices 220 (part of a player input system) connected to serial interface 211. These user interface devices may include various player input devices such as mechanical buttons shown on button panel 106 in FIG. 1, and/or levers, and other devices. It will be appreciated that the interface between CPU 205 and other player input devices such as player card readers, voucher readers or printers, and other devices may be in the form of serial communications. Thus serial interface 211 may be used for those additional devices as well, or the gaming machine may include one or more additional serial interface controllers. However, the interface between peripheral devices in the gaming machine, such as player input devices, is not limited to any particular type or standard for purposes of the present invention.

Reel Assembly 213 is shown in the diagrammatic representation of FIG. 2 to illustrate that a gaming machine which may be used for various embodiments of the present invention may include mechanical reels. For example, a number of sets of mechanical reels may replace the primary display device 104, or at least part of that display device. Alternatively, mechanical reels may be included in the gaming machine behind a light-transmissive video display panel. In either case, the mechanical reels represent a display device for displaying various game symbols in the course of a game play. Although the invention is not limited to any particular mechanical reel arrangement or control system, mechanical reels may be controlled conveniently through serial communications which provide instructions for a respective stepper motor for each reel. Thus some embodiments of the present invention which employ mechanical reels may use a serial interface device such as serial interface 211 to control communications with the reel assembly, and may not include a direct bus interconnection as indicated by FIG. 2. Details of a mechanical reel arrangement and various accent lighting arrangements which may be associated with mechanical reels are not shown in the present figures so as to avoid obscuring the present invention in unnecessary detail.

Figure 3:
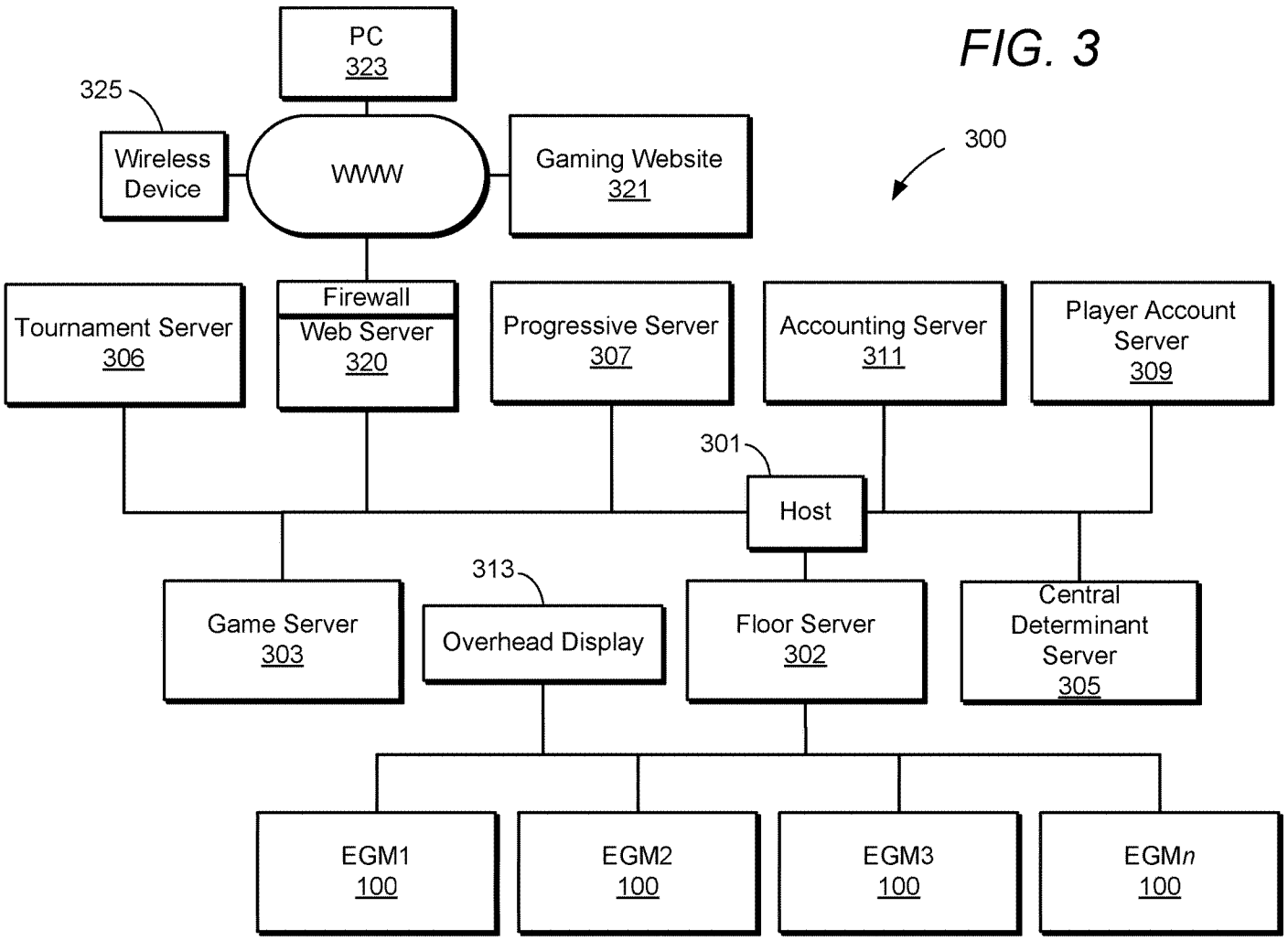
FIG. 3 is a diagrammatic representation of a gaming network in which the present invention may be implemented.

Referring now to FIG. 3, a networked gaming system 300 associated with one or more gaming facilities may include one or more networked gaming machines 100 ("electronic gaming machines" or "EGM's") connected in the network by suitable network cable or wirelessly. Networked gaming machines 100 (EGM1-EGMn) and one or more overhead displays 313 may be operatively connected so that the overhead display or displays may mirror or replay the content of one or more displays of gaming machines 100. For example, the primary display content for a given gaming machine 100 (including a game play according to the present invention) may be transmitted through network controller 210 to a controller associated with the overhead display(s) 313. In the event gaming machines 100 have cameras installed, the respective player's video images may be displayed on overhead display 313 along with the content of the player's gaming machine display.

The example gaming network 300 shown in FIG. 3 includes a host server 301 and floor server 302, which together may function as an intermediary between floor devices such as gaming machines 100 and back office devices such as the various servers described below. Game server 303 may provide server-based games and/or game services to network connected gaming devices such as gaming machines 100. Central determinant server 305 may be included in the network to identify or select lottery, bingo, or other centrally determined game outcomes and provide the outcome information to networked gaming machines 100 which present the games to players.

Tournament server 306 may be included in the system for controlling or coordinating tournament functions. These functions may include maintaining tournament player scores and ranking in real time during the course of tournament play, and communicating this information to the various gaming machines 100 participating in the tournament. Tournament server 306 may also function to enroll players in tournaments, schedule tournaments, and maintain the time remaining in the various tournaments.

Progressive server 307 may maintain progressive pools for progressive games which may be available through the various gaming machines 100. In some implementations, progressive server 307 may simply receive communications indicating contribution amounts which have been determined by processes executing at the various gaming machines 100 or elsewhere in the gaming network. Alternatively, progressive server 307 may perform processes to determine the contribution amounts for incrementing the various progressive pools which may be maintained. Progressive server 307 may also periodically communicate current pool values back to the various gaming machines 100, and may participate in communicating awarded progressive prize amounts to the gaming machines and making adjustments to the progressive prize pools accordingly. In some implementations, progressive server 307 may also determine or participate in determining when a progressive prize triggering event occurs.

Accounting server 311 may receive gaming data from each of the networked gaming devices, perform audit functions, and provide data for analysis programs. Player account server 309 may maintain player account records, and store persistent player data such as accumulated player points and/or player preferences (for example, game personalizing selections or options).

Example gaming network 300 also includes a gaming website 321 which may be hosted through web server 320 and may be accessible by players via the Internet. One or more games may be displayed as described herein and played by a player through a personal computer 323 or handheld wireless device 325 (for example, a Blackberry® cell phone, Apple® iPhone®, personal digital assistant (PDA), iPad®, etc.). To enter website 321, a player may log in with a user name that may, for example, be associated with the player's account information stored on player account server 309. Once logged in to website 321 the player may play various games on the website, including games according to the invention. Also website 321 may allow the player to make various personalizing selections and save the information so it is available for use during the player's next gaming session at a casino establishment having the gaming machines 100.

It will be appreciated that gaming network 300 illustrated in FIG. 3 is provided merely as an example of a gaming network in which configurable games according to embodiments of the present invention may be implemented, and is not intended to be limiting in any way. The invention is not limited to use in games offered through a gaming network (via the gaming website 321, or via gaming machines such as gaming machines 100, or otherwise). For example, a gaming machine configured according to one or more embodiments of the present invention to facilitate skill level configuration may comprise a stand-alone gaming machine having a configuration similar to gaming machine 100 or having any other gaming machine configuration. Also, where skill level configuration systems as described herein are offered through gaming machines included in a gaming network, the network need not have the configuration shown for purposes of example in FIG. 3. In particular, servers shown separately in the example of FIG. 3 may be combined in a single physical processing device, or the processing duties of the various illustrated servers may be split into additional physical devices.

Figure 4:
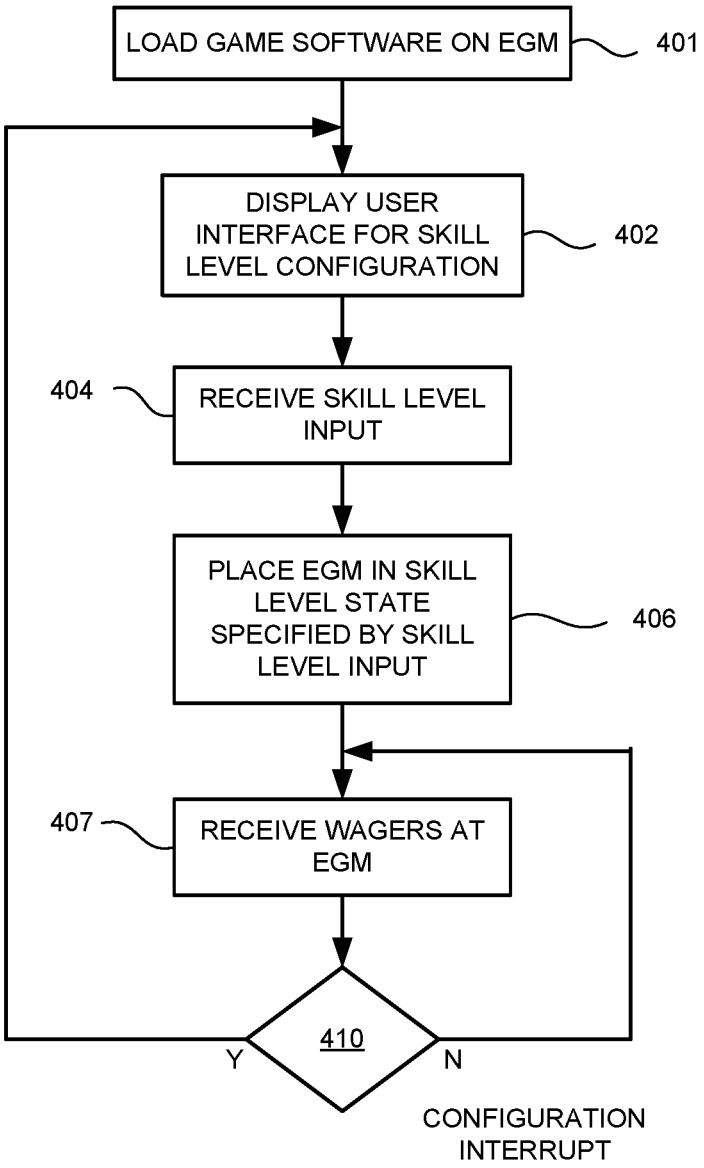
FIG. 4 is a flow diagram illustrating process steps for selecting a skill level for a wagering game according to one example embodiment.

The flow diagram of FIG. 4 shows a process in which a wagering game may be configured to include skill-dependent play according to one embodiment of the present invention. The illustrated process starts with loading game software for the wagering game on an electronic gaming machine (such as gaming machine 100 described above) as shown at process block 401. This step represents simply storing the wagering game software at storage included at the gaming machine or at least accessible to the gaming machine. Process block 402 shows that a user interface is displayed at the gaming machine preferably through a suitable display device such as one of the displays shown in the example gaming machine 100 of FIG. 1. The user interface includes one or more elements to allow the user to select a skill level for the wagering game and may include other controls for configuring other aspects of the wagering game. The illustrated method then includes receiving a skill level input as shown at process block 404. In response to the skill level input the method includes placing the gaming machine in a skill level state specified by the skill level input. More on controls for receiving the skill level input will be described below in connection with FIGS. 5-8.

Process block 406 shows that the wagering game is ultimately launched at the gaming machine and is placed in a condition in which a player may enter wagers as indicated at process block 407 and initiate plays of the wagering game. Game play continues in this state until the active play state of the gaming machine is interrupted for further configuration. In the event of such an interruption as indicated by an affirmative outcome at decision box 410, the process returns to display the user interface at block 402 to allow the user to change the skill level or perhaps change other wagering game characteristics or parameters.

The process shown in FIG. 4 is representative of a process that would be applied when the skill level game is first configured at a gaming machine by a gaming machine operator such as authorized casino personnel. The illustrated process also assumes that it is performed at the gaming machine itself through an administrative interface that may be invoked by the gaming machine user/operator. However, it should be appreciated that the user interface may be invoked remotely in a gaming network such as a network shown in FIG. 3. Also, it is possible that a player may be allowed to access the user interface to select a skill level for the wagering game. This user interface may be the same interface used by casino personnel or may be a separate interface, perhaps with reduced functionality so as to be more suitable for player use.

As will be discussed below in connection with FIG. 13, some implementations of the invention may include an arrangement for dynamically modifying the skill level for a wagering game implemented at a gaming machine. Of course, there is not necessarily a user interface for the selection in these embodiments. Rather the change in skill level is made automatically by one or more processing devices in reaction to certain conditions at the gaming machine or perhaps elsewhere. These dynamic skill level modification implementations may, however, include options that may be set by a user through a suitable user interface such as the interface displayed in accordance with process block 402 in FIG. 4. For example, a user may use a suitable interface to select an intervention return-to-player value such as that described below in connection with FIG. 13.

FIGS. 5-8 show various controls that may be shown on a user interface such as that displayed in accordance with process block 402 in FIG. 4. The example control shown in FIG. 5 comprises a sliding scale control that presents a range 502 of skill levels, in this case from 0% skill to 100% skill. The user selects a skill level by moving a position indicator 504 along the range to select the desired proportion of skill level for the wagering game. This particular sliding scale arrangement also includes a numeric value 505 which dynamically changes as the position indicator 504 is moved along the scale to better show to the user which skill level is indicated by the position of the control. The particular sliding scale sample in FIG. 5 allows position indicator 504 to be positioned in 1% increments along the scale. Thus the user may select a percent skill level indicated by any whole number from zero to 100.

Figure 5:
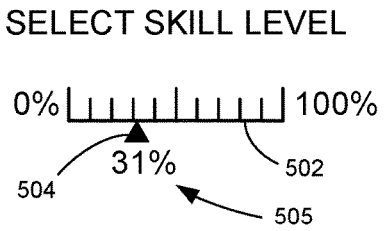
FIG. 5 is a representation of a portion of a user interface through which a user may select a skill level for a wagering game.
Figure 6:
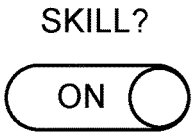
FIG. 6 is a representation of a portion of an alternate user interface through which a user may select a skill level for a wagering game.
Figure 7:
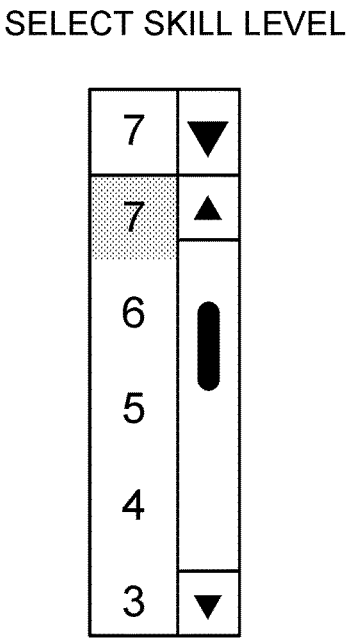
FIG. 7 is a representation of a portion of another alternate user interface through which a user may select a skill level for a wagering game.
Figure 8:
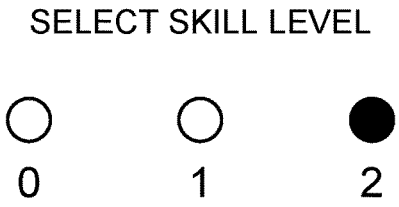
FIG. 8 is a representation of a portion of another alternate user interface through which a user may select a skill level for a wagering game.

The example controls of FIGS. 6-8 allow the selection of a desired skill level but at a lower granularity than the example sliding scale of FIG. 5. In particular, FIG. 6 comprises a binary control in which a user may choose a position in which a portion of the wagering game includes a skill-dependent component or alternatively a position in which the game includes no skill-dependent component. The drop-down menu and scroll bar of FIG. 7 allows the user to select from a number of discrete skill levels, for example, skill levels between 0 and 10. FIG. 8 shows another type of control allowing selection of discrete skill levels. In the case of the control in FIG. 8, the user may select between three different skill levels. Skill level 2 is shown selected in the particular example.

The numeric value of a given skill level may be defined in any suitable fashion for any of the controls shown in FIGS. 5-8. However, in any case the given skill level will correlate to a proportion between a skill-dependent component of a portion of a wagering game and a random component of the portion of the wagering game. In the example of FIG. 5, the 0% at the low end of the scale may represent a skill level in which there is no skill-dependent component and the outcome of play is entirely random. The 100% value at the opposite end of the scale may represent a condition in which the game result is entirely dependent upon player skill with no random component. Between these two extremes are varying proportions between the skill-dependent component and random component. The example 31% shown in FIG. 5 may represent a level in which the skill-dependent component makes up 31% of the wagering game result and 69% of the wagering game result is randomly determined. In contrast, the binary control and FIG. 6 simply allows a selection between the situation in which the game result is purely random and a condition in which the game result is at least somewhat dependent upon player skill. The particular proportion in which the skill component is nonzero may be any desired proportion, and there may be a separate field or window to allow the user to designate that proportion. Similarly the proportions associated with the skill levels in the example controls of FIGS. 7 and 8 may be any suitable proportions. For example, each skill level in the drop-down menu may represent a corresponding percent proportion between the skill-dependent component and random component. A natural assignment of proportion would be 70% for skill level 7, 60% for skill level 6, and so forth. The skill level proportions defined for the different options shown in FIG. 8 may again be selected in any suitable fashion. For example skill level 0 in FIG. 8 may correspond to no skill-dependent component for the wagering game while skill level 2 may represent a 100% skill-dependent component and skill level 1 may represent some intermediate value such as a 50% proportion between the skill-dependent component and random component.

Figure 9:
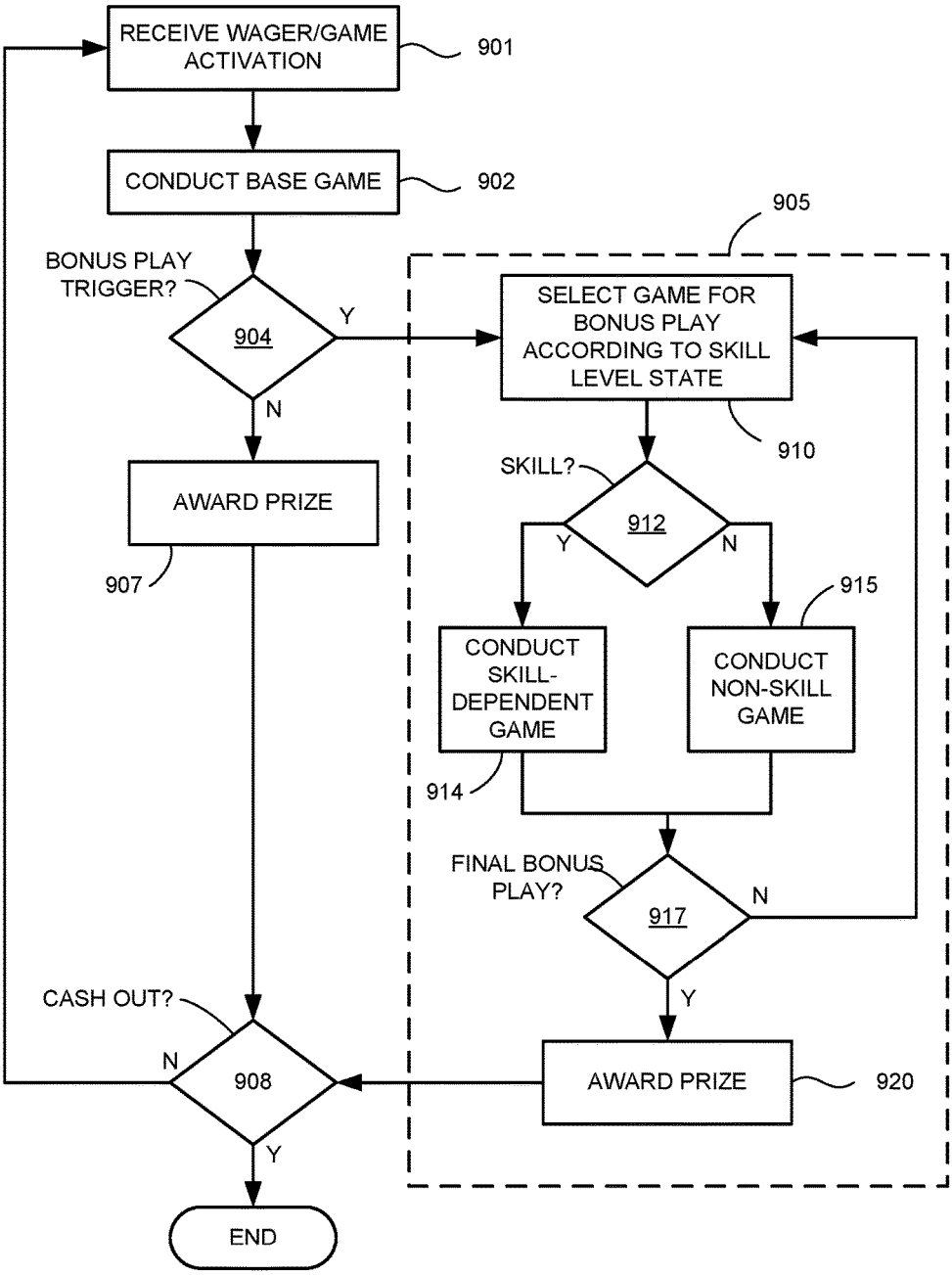
FIG. 9 is a flow diagram illustrating process steps according to one example embodiment for implementing a skill level selected for a wagering game.

The example of FIG. 9 shows a method according to an embodiment of the invention for implementing the selected proportion between the skill-dependent component and the random component of a portion of a wagering game. This example process is performed for each wager and activation of the wagering game. The process assumes that the desired proportion between the skill-dependent component and random component has been selected such as in the process described above in connection with FIG. 4 for example. However, the desired proportion of skill-dependent component to random component could be selected is any fashion including dynamically as will be discussed below in connection with FIG. 13.

The process shown in FIG. 9 includes receiving a wager/activation in the underlying wagering game as indicated at process block 901. This step may be performed in any suitable fashion through the player input system associated with the gaming machine (such as 100 in FIG. 1), and may commonly include player inputs to select a wager and then a separate player input to initiate the play for that wager through a "play" button or lever. In response to the activation, the gaming machine conducts a base game as indicated at process block 902 to obtain a purely random or pseudo random result for this first or base portion of the game in this example embodiment. As indicated by the decision box 904 if bonus play is triggered for this instance of the base game, the process branches to a portion of the process which introduces a skill-dependent component. This portion of the process is indicated in dashed box 905. Otherwise the method includes awarding a prize for the result in the base game as indicated at process block 907. Unless the player discontinues play at the gaming machine by cashing out, the process branches back from decision box 908 to receive the next wager and game activation at process block 901.

If bonus play is triggered as indicated by an affirmative outcome at decision box 904, the process includes selecting a game to play according to the skill level in affect at the time as shown at process block 910. That is, the process selects between a game having a skill-dependent component and a non-skill game in which the result is not dependent on player skill and is purely random. If the skill-dependent game is selected, the process branches from decision box 912 to conduct the selected skill-dependent game as indicated at process block 914. Otherwise the process branches to conduct the non-skill game as indicated at process block 915. If not the final round or game in bonus play, the process loops back from decision box 917 to select the next game for that bonus play at process block 910. Otherwise a prize is awarded for the bonus play according to the results achieved in the bonus play game or games as indicated at process block 920. The illustrated process then either ends if the player cashes out at the gaming machine our returns to process block 901 for the next wager and game activation.

The selection at process block 910 and FIG. 9 is made so that over a given number of instances of bonus game plays, the desired proportion of the overall result is skill-dependent. For example assuming that the desired proportion of the skill-dependent component to random component is 40%, the selection that process block 910 is controlled by suitable random or pseudo-random selection process so that 40% of the instances of bonus play will be branched to the skill-dependent game while the rest of the instances branch to the non-skill or random component game. Thus, this particular implementation of the invention employs at least two different games and multiple instances of these games to produce the desired proportion between the skill-dependent component and random component for a portion of a wagering game. The prize awarded at 920 represents to sum of outcomes for the individual bonus plays through blocks 914 and 915 up through the final bonus play for the given instance of the process shown in dashed box 905.

The present invention encompasses numerous variations on the example process shown in FIG. 9. At the outset it should be noted that the selection between conducting a skill-dependent game and a non-skill game as indicated in dashed box 905 need not be for bonus plays. Rather, the selection between a skill-dependent game and a non-skill game such as at block 910 may be for the base game rather than bonus play. The selection may occur once for each wager and activation of the base game, or each wager and activation of the base game may include multiple separate plays and the selection may occur for these separate plays. Also, although this example appears to choose between two different games, a single skill-dependent game in a single non-skill game, it should be appreciated that there be may be multiple different options for the two different types of games, including player-selectable options (such as between a trivia skill game and a physical reflex skill game, for example). Each skill-dependent game need not be entirely skill-dependent and may include a random component. Of course any such random component would need to be considered in the selection at process block 910 to produce the desired overall proportion between the skill-dependent component and random component. Furthermore, the skill-dependent games need not all include the same level of skill dependency. Some skill-dependent claims which may be selected according to process block 910 may include a high skill-dependent component while others a lower skill-dependent component.

Figure 10:
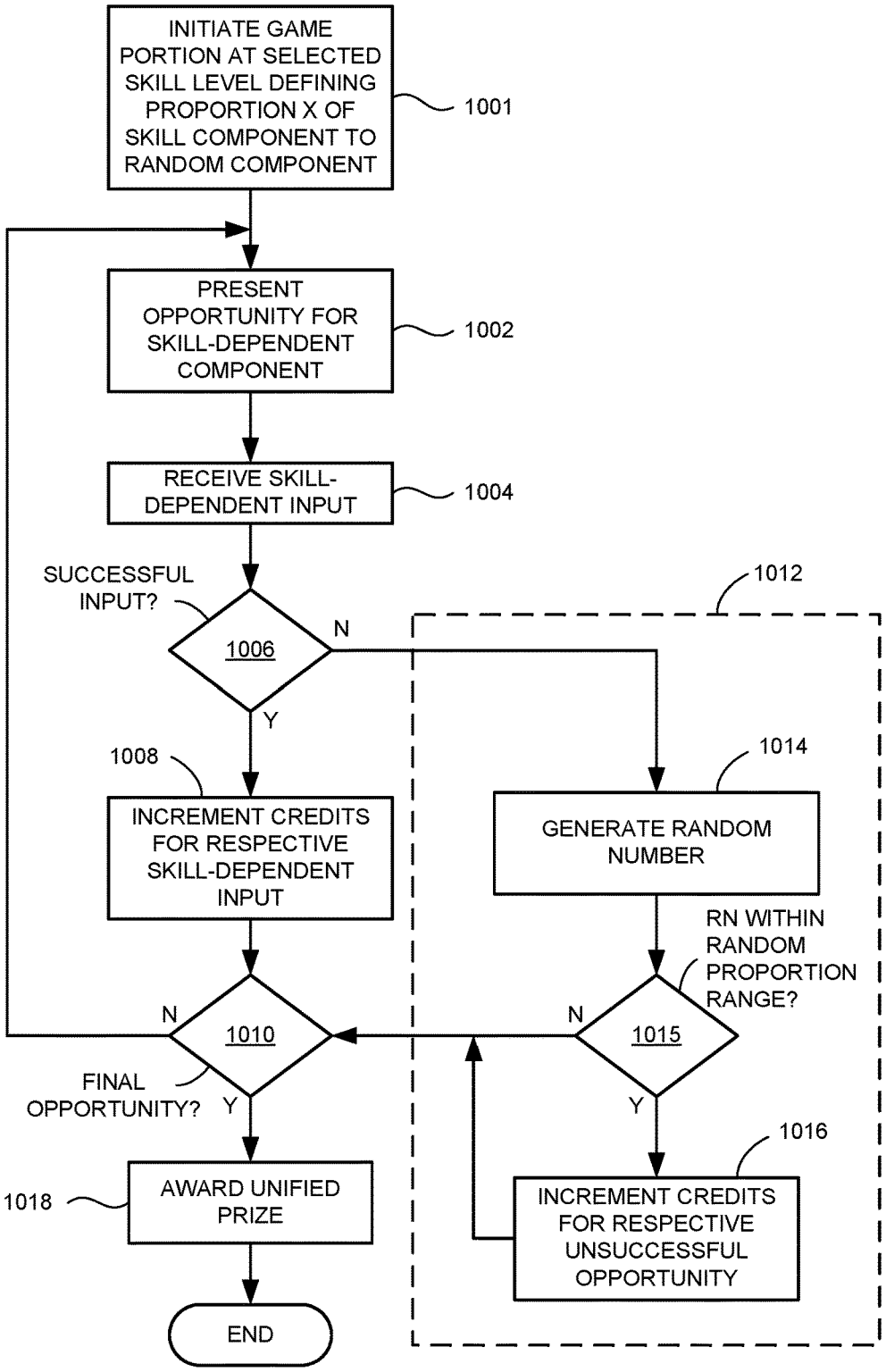
FIG. 10 is a flow diagram illustrating process steps according to an alternate embodiment for implementing a skill level selected for a wagering game.

FIG. 10 provides a flow diagram of an alternate process to implement a desired proportion of skill-dependent component to random component in accordance with the present invention. The process shown in FIG. 10 is not dependent on multiple different types of games such as the skill-dependent and non-skill games shown in the process of FIG. 9. Rather, this alternative process shown in FIG. 10 provides a way to include the random component and skill-dependent component in a single wagering game.

The process in FIG. 10 includes first initiating the game portion at the selected skill level defining the desired proportion of skill-dependent component to random component. The proportion here shown as a value X. The step of initiating the game portion as shown at process block 1001 in FIG. 10 may correspond to the step shown at 901 in FIG. 9 in the event the game in FIG. 10 is a primary or base game. The initiating step at block 1001 of FIG. 10 may alternatively correspond to a trigger process such as the process indicated at decision box 904 in FIG. 9 in the event the game is a bonus or secondary game which is simply part of an overall game for which the wager is placed. Also, the proportion of skill-dependent component to random component X may be selected or set in any suitable fashion such as through the configuration process set out in the example of FIG. 4 or the dynamic process described below in connection with FIG. 13.

Regardless of the specific nature of the game initiation step, the process in FIG. 10 then includes presenting through a suitable component of the gaming machine an opportunity for player input for the skill-dependent component of the game as indicated at process block 1002. The player may then make one or more inputs for this opportunity which are received as indicated at process block 1004. As indicated by an affirmative outcome at decision box 1006, for each successful input the process branches to increment credits for that respective opportunity and skill-dependent input as indicated at process block 1008. However, if the player input for the presented opportunity is unsuccessful, the process branches from decision box 1006 to the process indicated in dashed box 1012. This process in dashed box 1012 introduces a random component of the game. In this particular example arrangement, the process includes generating a random number within a range defined by the selected proportion of skill-dependent component to random component as shown at process block 1014. In the event the random number generated at block 1014 is within a portion of the range defining the random component probability as indicated by an affirmative outcome at decision box 1015, the process includes incrementing credits for the respective unsuccessful opportunity as shown at process block 1016. Otherwise no credits are incremented for the unsuccessful player input.

An example implementation of the process shown in dashed box 1012 of FIG. 10 might define the range for the random number to be whole numbers from 1 to 100. In this case, where the selected proportion of skill-dependent component to random component is 40% for example, where the random number (generated at block 1014) is from 1-40, the result at decision box 1015 would be negative, while a random number from 41 to 100 would produce an affirmative result at decision box 1015.

Once credits are incremented as indicated at process blocks 1008 or 1016, or if no credits are incremented in the process in dashed box 1012 as the case may be, the process includes determining if the opportunity presented at block 1002 is the final opportunity for the game. In the event the opportunity presented at process block 1002 is not the final opportunity for this instance of the wagering game, the process loops back to present the next opportunity for a player skill-dependent input at process block 1002. Otherwise the process branches from decision box 1010 to award a unified prize as shown at process block 1018. The unified prize includes the credits incremented at process block 1008 over the course of the various opportunities for the game and any credits incremented at process block 1016 over the course of those opportunities. The process then ends in a suitable fashion depending upon whether the game is a standalone game or a portion of another game such as the bonus play for a base game as shown in FIG. 9 as will be discussed further below.

In contrast to the process shown in FIG. 9 which uses separate instances of skill-dependent and non-skill games to enforce the selected proportion of skill-dependent component to random component for the wagering game or portion thereof, the process of FIG. 10 uses a single game in which credits are collected for the skill-dependent inputs so as to enforce the selected proportion of skill-dependent component to random component. An example game which may be used to implement the process in FIG. 10 will be described below in connection with FIGS. 11 and 12.

Figure 11:
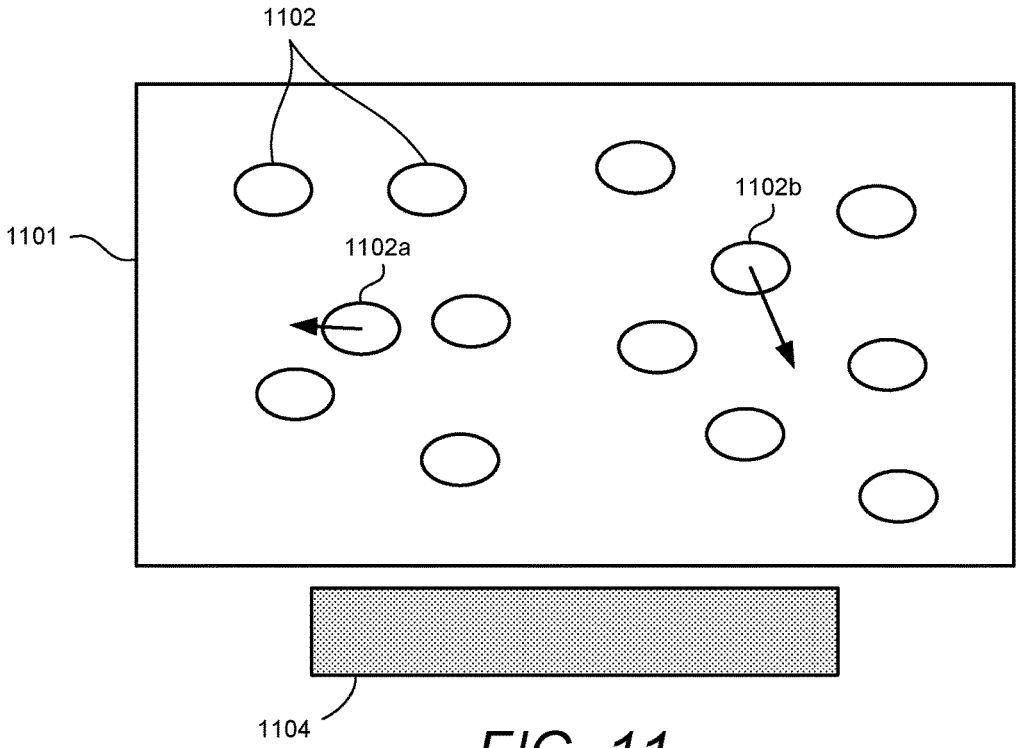
FIG. 11 is a representation of a player interface for receiving skill-dependent inputs within the scope of the present invention.
Figure 12:
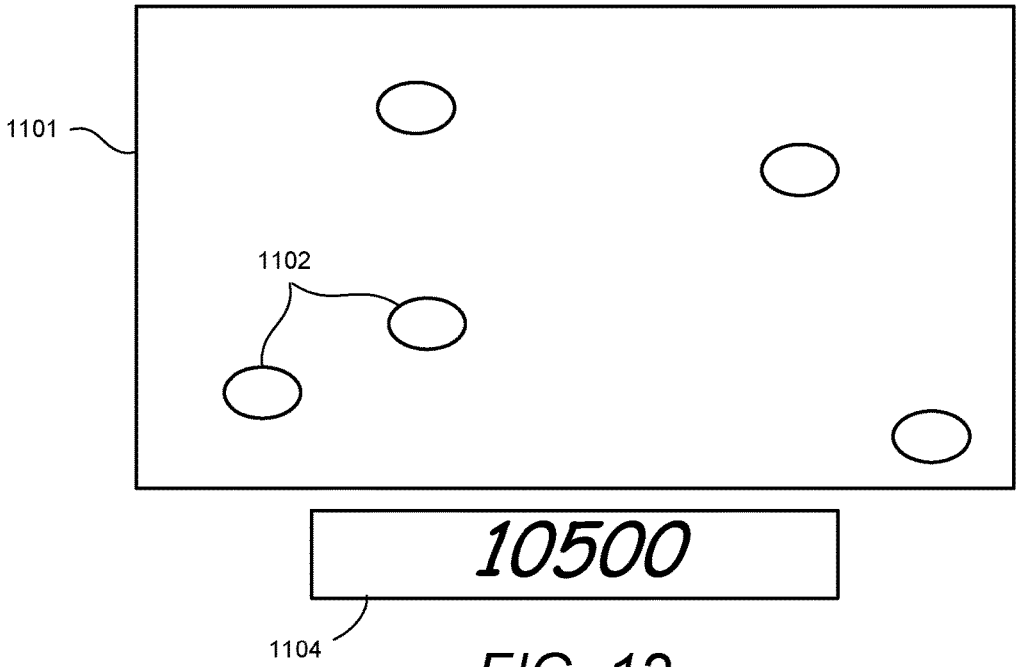
FIG. 12 is a representation of the player interface of FIG. 11 at the completion of a set of skill-dependent inputs.

The example game shown in FIGS. 11 and 12 includes a display area 1101 in which a number of objects 1102 are displayed. These objects 1102 are displayed moving actually or apparently randomly across the area of the display area 1101. For example, object 1102*a* is shown moving in a direction and speed indicated by the associated arrow (representing a vector quantity) while object 1102*b* is shown moving in another direction and speed indicated by the vector/arrow associated with that object. The objects may move in any fashion across the display area 1101 entering along one edge, changing speed and or direction one or more times, and then ultimately exiting the display area. Credits are awarded in this example game at least in part (according to the desired skill component proportion) by the input of a player interacting with the objects 1102 as they move across the area 1101. For example, the display area 1101 may be presented on a touch screen display and a successful player input may be defined as a player touch in the area of an object 1102 as it moves across the area. Alternatively to a simple touch, the player may be required to swipe across an object 1102 in some fashion, for example, to force the object to exit the area 1101 along a given edge or target portion of an edge. Other types of inputs from the player that may be taken as a successful input might be a targeting and simulated shooting of an object 1102 with a projectile such as from a simulated firearm. Thus each object 1102 may represent an opportunity for a player skill-dependent input that may be judged successful or unsuccessful. The condition in which an object 1102 enters the area 1101 but receives no successful interaction or input from the player may be defined as an unsuccessful opportunity. The award ultimately displayed for an instance of the game at award area 1104 is dependent at least in part on a players input related to the objects 1102. Regardless of the player input or interaction required for a successful input, each successful input results in the branch to process block 1008 in FIG. 10 and each unsuccessful input causes a branch to the random component insertion process shown for example in dashed box 1012 of FIG. 10. At least at the completion of the example game shown in FIG. 11, the area 1104 is used to display the unified prize which is awarded for the given instance of the game in accordance with process block 1018 in FIG. 10. For example, FIG. 12 shows that the player has been awarded the unified prize of 10500 credits for an instance of the game.

Among the numerous variations which may be employed in the example game shown in FIGS. 11 and 12, the award area 1104 may show the collection of credits over the course of the game based at least on the successful skill-dependent inputs. Alternatively, award area 1104 may be grayed out as shown in FIG. 11 over the course of the game or the incremental collection of credits may be otherwise fully or partially obscured from the player during the course of the game. For example, the award area 1104 may be displayed as a closed treasure chest which only opens to display a prize (representing the unified prize) at the completion of the instance of the game. In any case, the final award shown at the completion of the game in accordance with process block 1018 in FIG. 10 will include both credits added in accordance with process block 1008 and credits added in accordance with the random component of the game in process block 1016 of FIG. 10.

In addition to the processes illustrated in FIGS. 9 and 10 for introducing a desired skill-dependent component into a wagering game, the present invention may include a set of individual games which are each defined to provide a certain proportion of skill-dependent component to random component which may be selected in accordance with the process shown for example in FIG. 4. For example, different versions of the game shown in FIGS. 11 and 12 may be available, each implemented to provide a defined skill level (proportion between skill component and random component) and an expected return-to-player. The rules of the game in terms of successful player inputs and the manner in which the objects 1102 move in the area 1101 may be defined for a given version of the game to provide a higher or lower skill-dependent component, with each version having substantially the same expected return-to-player. For example, the speed or randomness with which the objects 1102 move in the example game may be increased to increase the skill-dependent component, while the number of objects presented may be increased accordingly to produce the desired expected return-to-player. This balance to produce the desired proportion of skill-dependent component to random component and desired expected return-to-player may be determined empirically or via game modelling, for example.

Implementations of the present invention for selecting a desired skill level, that is, skill to random component proportion, is not limited to any particular type of skill. For example, the skill component may be skill at trivia or knowledge of a particular subject, or skill at a card game such as Black Jack or Poker games. Alternatively, the skill component may test physical skill such as eye-hand coordination, targeting, reflexes, or combinations of physical skill. Also, for a given wagering game or portion thereof, the skill component may include different types of skill such as trivia and reflexes or hand speed. For example, the different skill games available in dashed box 905 in FIG. 5 may test different types of skill and the different opportunities presented at 1002 in FIG. 10 may test different skills.

Figure 13:
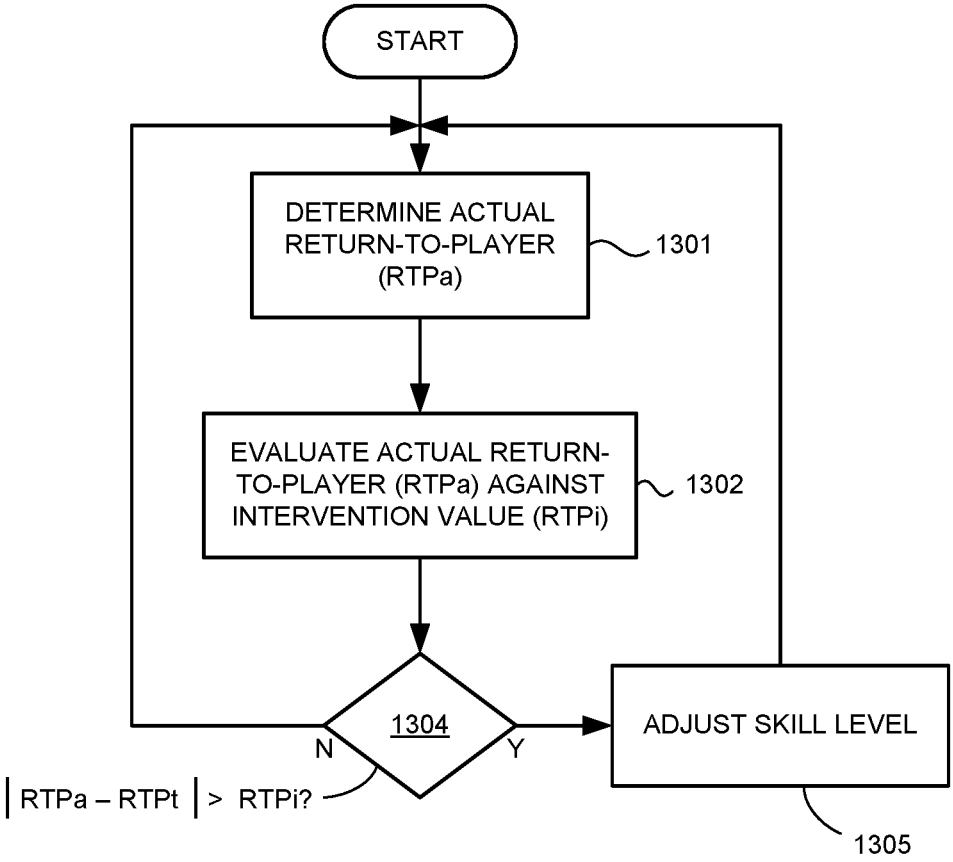
FIG. 13 is a flow diagram illustrating process steps that may be performed to dynamically modify a skill level for a wagering game.

FIG. 13 shows an arrangement which may be implemented to dynamically modify the proportion between the skill-dependent component and random component for a given game or set of games. This example process includes monitoring the skill-dependent inputs such as by continuously or periodically calculating an indicator of the degree to which the skill-dependent component is affecting the prizes awarded to the player for the wagering game. This calculation may be for an actual return-to-player as shown at block 1301 in FIG. 13. The example process includes evaluating this monitored value or a value derived from this monitored value to an intervention value which has been set for the system. For example, process block 1302 shows an evaluation of the absolute value of the difference between the actual return-to-player (RTPa) and the theoretical return-to-player (RTPt) to an intervention return-to-player (RTPi) value. The theoretical return-to-player represents a return-to-player determined empirically by the game designer and is a value advertised to the casino operator for the given game. In this example if the absolute value of the difference between the actual return-to-player (RTPa) and the theoretical return-to-player (RTPt) exceeds the intervention return-to-player (RTPi) value, that is if $|RTPa-RTPt|>RTPi$ then an intervention in return-to-player is indicated. Stated another way for this example, if actual return-to-player strays too far from the theoretical return-to-player (that is, by the value set for RTPi) as might occur if the player's skill-dependent inputs were less or more successful than expected (theoretical), then an intervention is indicated to make the return-to-player less affected the player's skill-dependent inputs. In any event, if the monitored value reaches the defined relationship to the intervention value as indicated by an affirmative outcome at decision box 1304 the process includes adjusting the proportion of skill-dependent component to random component as shown at process block 1305. For example if the comparison at process block 1302 indicates that the player's success rate has fallen below a certain minimum value for the success rate in the skill-dependent component (as indicated by |RTPa−RTPt|>RTPi in this example), the adjustment at process block 1305 may reduce the proportion of skill-dependent component to random component and thus make the skill-dependent component less determinative of the player's awards.

Although FIG. 13 show one example arrangement, numerous variations are possible to effect the desired monitoring of the results of a player's skill-dependent inputs and the effect such inputs have on the player's awards. For example, rather than calculating actual return-to-player, some other indicator may be calculated at block 1301 such as the ratio of the total number of opportunities to successful skill-dependent inputs. The evaluation in such a case could be to some intervention value of the ratio or between an actual-to-theoretical value differential and the intervention value. Also, although the example shown in FIG. 13 includes making an adjustment at process block 1305 if the player's skill-dependent inputs increase actual return-to-player (or an indicator of this value) too much relative to theoretical, an adjustment may be made only if the actual return-to-player or indicator value falls too much relative to theoretical.

The present invention for configuring a skill component to random component for a wagering game is not limited to any particular type of wagering game provided the game includes or is modified to include some skill-based player input. Also, a skill component may be configured according to the present invention for in-revenue or out-of-revenue tournament games conducted through electronic gaming machines. For example, skill configuration may be part of the tournament configuration described in the tournament system disclosed in U.S. Pat. No. 8,469,788, the entire content of which is incorporated herein by this reference. The skill level can be configured on a gaming machine-by-gaming machine basis or a group basis though the tournament user interface console of a control center server as disclosed in that patent. Also, the skill level may be adjusted dynamically on a gaming machine-by-gaming machine basis or group basis in accordance with the process shown in FIG. 13. In the case of dynamic skill level configuration, return-to-player may be meaningless in the case of an out-of-revenue tournament, so a different indicator could be monitored such as individual or group (team) success-to-opportunity rate, to provide a basis for adjusting the skill component of a given one or group of gaming machines during tournament play.

As used herein, whether in the above description or the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The term "each" may be used in the following claims for convenience in describing actions, functions, characteristics, or features of multiple elements, and any such use of the term "each" is in the inclusive sense unless specifically stated otherwise. For example, if a claim defines two elements as "each" having a characteristic or feature, the use of the term "each" is not intended to exclude from the claim scope a situation having a third one of the elements which does not have the defined characteristic or feature.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method for introducing player skill-dependent play through a gaming machine for a wagering game, the method including:

(a) through a user interface operatively connected to the gaming machine, receiving a skill level input specifying a first skill level from a set of different skill levels, each respective skill level in the set of different skill levels being correlated to a different respective proportion between a player skill-dependent component of a portion of the wagering game and a random component of the portion of the wagering game;

(b) in response to the skill level input, placing the gaming machine in a first state corresponding to the first skill level and in which the proportion between the player skill-dependent component and the random component for the portion of the wagering game has a first value;

(c) after placing the gaming machine in the first state, receiving through a player input system of the gaming machine a player input set for the portion of the wagering game, the player input set including at least one player input;

(d) with a processing system associated with the gaming machine, performing the portion of the wagering game including multiple discrete activations of either a first game having a first proportion between a player skill-dependent component and a random component for the first game or a second game having a second proportion between a player skill-dependent component and a random component for the second game, and for each of the multiple discrete activations, selecting the first game or the second game so that an overall proportion between the player skill-dependent component and random component for the multiple discrete activations is equal to the first value, and including selections of the first and second games; and (e) in response to the player input set for the portion of the wagering game, and under control of a processing system associated with the gaming machine, awarding a prize at the gaming machine for the portion of the wagering game, the prize determined by (i) any player inputs included in the player input set for the player skill-dependent component and (ii) the random component in an award proportion based on the first value.

2. The method of claim 1 wherein the first proportion between the player skill-dependent component and random component for the first game is equal to 100% and the second proportion between the player skill-dependent component and random component for the second game is equal to 0%.

3. The method of claim 1 wherein the player input set includes a number of skill-dependent inputs and the prize awarded at the gaming machine includes a unified value displayed through a display system of the gaming machine after completion of the number of skill-dependent inputs, the unified value including a portion determined at random according to the first value for the proportion between the player skill-dependent component and the random component for the portion of the wagering game.

4. The method of claim 3 wherein the prize awarded at the gaming machine is made up of (i) a respective first credit award for each successful skill-dependent input in the player input set, and (ii) for each unsuccessful skill-dependent input in the player input set, a respective credit award issued according to a probability equal to unity less the first value.

5. The method of claim 1 wherein the user interface includes a continuum over a range of skill level values and wherein receiving the skill level input includes receiving an indication of a placement of a position indicator along the continuum.

6. The method of claim 1 wherein the user interface includes a control displaying a number of alternatively selectable discrete skill levels and wherein receiving the skill level input includes receiving an input corresponding to a selected one of the discrete skill levels.

7. The method of claim 1 further including monitoring an indicator of a degree to which the player skill-dependent component is affecting a return to the player and, in response to the indicator reaching a predefined intervention value, placing the gaming machine in a second state having a lower proportion of player skill-dependent component to random component for the portion of the wagering game.

8. A gaming machine including:

(a) a display system;

(b) a data storage system;

(c) a user interface operable to receiving a skill level input specifying a first skill level from a set of different skill levels, each respective skill level in the set of different skill levels being correlated to a different respective proportion between a player skill-dependent component of a portion of a wagering game and a random component of the portion of the wagering game;

(d) a player input system operable to receive a player input set for the portion of the wagering game, the player input set including at least one player input; and (e) at least one processor operable to execute program code to control the gaming machine to:

(i) in response to the skill level input, place the gaming machine in a first state corresponding to the first skill level and in which the proportion between the player skill-dependent component and the random component for the portion of the wagering game has a first value, (ii) perform the portion of the wagering game including multiple discrete activations of either a first game having a first proportion between a player skill-dependent component and a random component for the first game or a second game having a second proportion between a player skill-dependent component and a random component for the second game, and for each of the multiple discrete activations, select the first game or the second game so that an overall proportion between the player skill-dependent component and random component for the multiple discrete activations is equal to the first value, and including selections of the first and second games, (iii) after the gaming machine is in the first state, and in response to the player input set for the portion of the wagering game, awarding a prize at the gaming machine for the portion of the wagering game, the prize determined by (A) any player inputs included in the player input set for the player skill-dependent component and (B) the random component in an award proportion based on the first value.

9. The gaming machine of claim 8 wherein the first proportion between the player skill-dependent component and random component for the first game is equal to 100% and the second proportion between the player skill-dependent component and random component for the second game is equal to 0%.

10. The gaming machine of claim 8 wherein the player input set includes a number of skill-dependent inputs and the prize awarded at the gaming machine includes a unified value displayed through a display system of the gaming machine after completion of the number of skill-dependent inputs, the unified value including a portion determined at random according to the first value for the proportion between the player skill-dependent component and the random component for the portion of the wagering game.

11. The gaming machine of claim 10 wherein the prize awarded at the gaming machine is made up of (i) a respective first credit award for each successful skill-dependent input in the player input set, and (ii) for each unsuccessful skill-dependent input in the player input set, a respective credit award issued according to a probability equal to unity less the first value.

12. The gaming machine of claim 8 wherein the at least one processor is also operable to execute program code to control the gaming machine to monitor an indicator of a degree to which the player skill-dependent component is affecting a return to the player and, in response to the indicator reaching a predefined intervention value, placing the gaming machine in a second state having a lower proportion of player skill-dependent component to random component for the portion of the wagering game.

13. A program product comprising one or more tangible, non-transitory computer-readable data storage devices storing program code, the program code including:

(a) user interface program code executable by one or more processing devices to receive a skill level input specifying a first skill level from a set of different skill levels, each respective skill level in the set of different skill levels being correlated to a different respective proportion between a player skill-dependent component of a portion of a wagering game and a random component of the portion of the wagering game;

(b) skill level configuration program code executable by the one or more processing devices to, in response to the skill level input, place a gaming machine in a first state corresponding to the first skill level and in which the proportion between the player skill-dependent component and the random component for the portion of the wagering game has a first value; and (a) game program code executable by one or more processing devices to, while the gaming machine is in the first state, receive through a player input system of the gaming machine a player input set for the portion of the wagering game, the player input set including at least one player input;

(b) the game program code further executable to perform the portion of the wagering game including multiple discrete activations of either a first game having a first proportion between a player skill-dependent component and a random component for the first game or a second game having a second proportion between a player skill-dependent component and a random component for the second game, and for each of the multiple discrete activations, select the first game or the second game so that an overall proportion between the player skill-dependent component and random component for the multiple discrete activations is equal to the first value, and including selections of the first and second games; and (c) payout program code executable by the one or more processing devices to, in response to the player input set for the portion of the wagering game, and under control of a processing system associated with the gaming machine, award a prize at the gaming machine for the portion of the wagering game, the prize determined by (i) any player inputs included in the player input set for the player skill-dependent component and (ii) the random component in an award proportion based on the first value.

14. The program product of claim 13 wherein the first proportion between the player skill-dependent component and random component for the first game is equal to 100% and the second proportion between the player skill-dependent component and random component for the second game is equal to 0%.

15. The program product of claim 13 wherein the player input set includes a number of skill-dependent inputs and the prize awarded at the gaming machine includes a unified value displayed through a display system of the gaming machine after completion of the number of skill-dependent inputs, the unified value including a portion determined at random according to the first value for the proportion between the player skill-dependent component and the random component for the portion of the wagering game.

16. The program product of claim 15 wherein the prize awarded at the gaming machine is made up of (i) a respective first credit award for each successful skill-dependent input in the player input set, and (ii) for each unsuccessful skill-dependent input in the player input set, a respective credit award issued according to a probability equal to unity less the first value.

17. The program product of claim 13 wherein the skill level configuration program code is also executable by the one or more processing devices to monitor an indicator of a degree to which the player skill-dependent component is affecting a return to the player and, in response to the indicator reaching a predefined intervention value, placing the gaming machine in a second state having a lower proportion of player skill-dependent component to random component for the portion of the wagering game.

* * * * *